United States Patent [19]

Spurkel

[11] 4,006,771

[45] Feb. 8, 1977

[54] MEANS FOR MAINTAINING A PAINTING AGAINST SHRINKAGE AND WARPING

[76] Inventor: Hermann Spurkel, 21-64 41st St., Long Island City, N.Y. 11105

[22] Filed: July 21, 1976

[21] Appl. No.: 707,226

[52] U.S. Cl. ..... 160/378

[51] Int. Cl.[2] ..... E06B 9/24

[58] Field of Search ..... 160/374.1, 368; 69/19, 69/19.1, 19.3; 38/102, 102.1, 102.2, 102.3, 102.4, 102.5, 102.6, 102.7, 102.8, 102.9, 102.91

[56] References Cited

UNITED STATES PATENTS

| | | | |
|---|---|---|---|
| 1,916,023 | 6/1933 | Shull | 160/374.1 |
| 2,456,225 | 12/1948 | Thomas | 38/102.91 |
| 2,891,603 | 6/1959 | Lilienfeld | 160/378 |
| 2,934,134 | 4/1960 | Adler | 160/378 |
| 3,950,869 | 4/1976 | Samarin | 160/378 |

*Primary Examiner*—Peter M. Caun
*Attorney, Agent, or Firm*—Charles Marks

[57] ABSTRACT

A plurality of turnbuckles are mounted upon a rigid base and affixed to a painting mounted upon a frame. The turnbuckles are disposed at angular intervals with respect to each other and are adjustable to maintain the painting in a predetermined position.

4 Claims, 5 Drawing Figures

FIG. 1
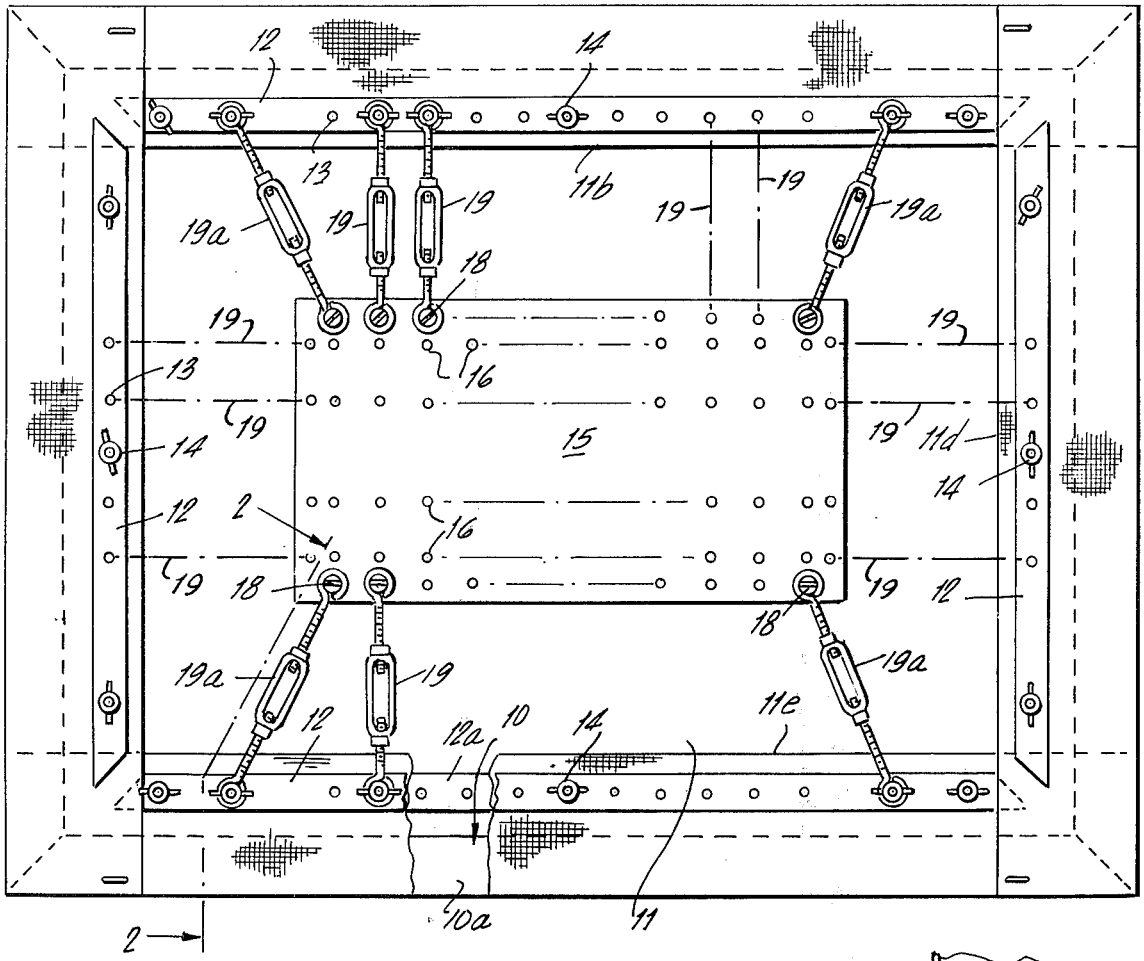
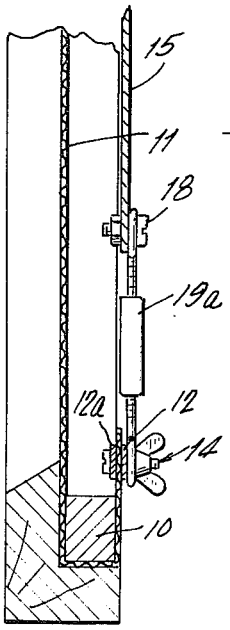
FIG. 2
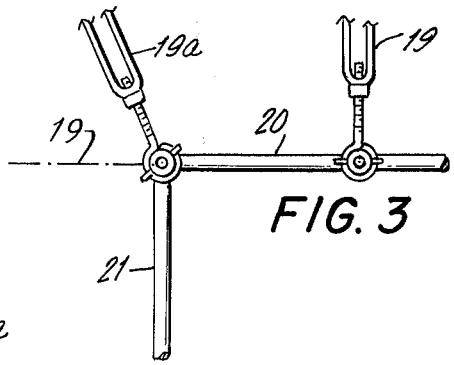
FIG. 3
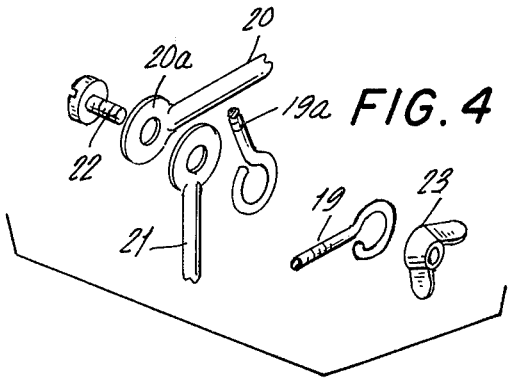
FIG. 4
FIG. 5
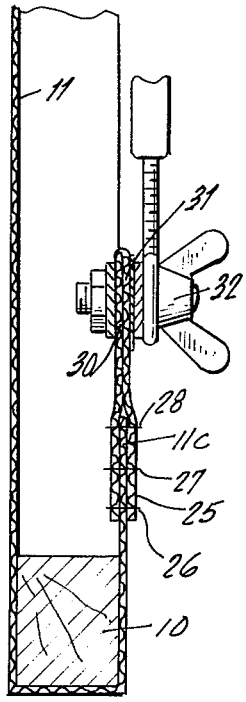

MEANS FOR MAINTAINING A PAINTING AGAINST SHRINKAGE AND WARPING

BACKGROUND OF THE INVENTION

1. Field of the Invention

This invention relates generally to means for preserving paintings against deterioration and is particularly concerned with an improved means for maintaining paintings against shrinkage, warping and cracking arising from the drying and aging of oil paintings and the like.

2. Description of the Prior Art

Heretofore it has been customary to retain oil paintings and the like in their original frames or to mount them in new frames. In either of these arrangements, it frequently happens that no adequate provision is made to protect the paintings against the inevitable shrinkage and warping, and their effects, which occur over a long period of time as a result of drying and other physical or chemical changes in the paints or pigments employed. Since these changes ultimately cause cracking, peeling and other forms of deterioration, many valuable and important works of art become damaged or deteriorated.

The present invention solves these problems. It is the object of the present invention to provide an improved means for maintaining a painting in a predetermined position where it is resistant to shrinkage, warping and cracking arising therefrom.

Another object of the invention is to provide a means of the character described which is adjustable to impose any desired degree of tension on such a painting.

Another object of the invention is to provide a means of the character described wherein the tension producing elements may be disposed in any desired position and at right angles or in other positions with respect to each other.

Another object of the invention is to provide an improved means for reinforcing and mounting very old paintings so as to prevent or minimize shrinkage, warping and cracking thereof.

Still another object of the invention to provide a simple, lightweight economical means of the character described which may be easily assembled with a painting and disposed in operative position.

Other and further objects of the invention will become apparent from the following description when read in conjunction with the accompanying drawing.

SUMMARY OF THE INVENTION

In the present invention, the edges of a canvas-bearing painting mounted upon a rectangular frame are disposed between support members, and a rectangular plate having a plurality of apertures is disposed rearwardly of the painting. A plurality of turnbuckles are removably mounted between fastening elements disposed in the apertures of the rectanglar plate and in apertures formed in the support members. Two or more of the turnbuckles are disposed at 90° intervals with respect to each other; and two or more of such turnbuckles may also be disposed in parallel positions. So, also, if desired, the turnbuckles may be disposed in inclined positions between zero and 90° . The turnbuckles and their fastening elements may be moved to any desired adjacent apertures in the support members and rectangular plate, and may be adjusted to any desired degree of tension or the canvas upon which it is received while at the same time maintaining the tension at a comparatively small magnitude so as to avoid the imposition of undesirably great stresses upon the painting.

In a modified form of the invention, a rigid frame is employed in lieu of the foregoing rectangular plate, such frame being provided with suitable means for accommodating fastening elements engageable with the turnbuckles.

In a still further form of the invention, which is employed with very old and relatively brittle or deteriorated paintings, their edges are reinforced by a suitable fabric sewn or otherwise fastened thereto, said fabric being accommodated between support members of the above described kind.

BRIEF DESCRIPTION OF THE DRAWING

In the drawing:

FIG. 1 is an elevational view of one embodiment of the invention in operative position;

FIG. 2 is a fragmentary cross-sectional view taken about the line 2—2 of FIG. 1;

FIG. 3 is a fragmentary elevational view of a modified form of the invention;

FIG. 4 is an exploded perspective view of various elements of said modified form of the invention;

FIG. 5 is a fragmentary cross-sectional view similar to that of FIG. 2 but depicting another modified form of the invention.

Throughout the various views, similar numerals are employed to refer to similar parts of the invention.

DESCRIPTION OF THE PREFERRED EMBODIMENT

As shown in FIGS. 1 and 2 of the accompanying drawing, one embodiment of the present invention comprises a rectangular frame, generally designated by the numeral 10, surmounted by a canvas 11 or other material, the frontward surface 11*a* of which has been painted upon in the conventional manner. The edges 11*b*, 11*c*, 11*d*, 11*e* of the canvas 11 extend inwardly of the rearward portion 10*a* of the frame 10 and between pairs of planar support members 12, 12*a*, provided with a plurality of apertures 13. The support members 12, 12*a* are maintained in tight and continuous engagement with the canvas 11 by means of suitable fastening means such as bolt and wing nut assemblies 14.

An important feature of the invention resides in a rectangular plate 15 which is disposed inwardly of the frame 10 and rearwardly of the canvas 11. This plate 15 is preferably composed of a light metal such as aluminum and is provided with a plurality of apertures 16 disposed at equal intervals in horizontal rows and columns. Each of the apertures 16 may accommodate a fastening means such as a nut and bolt assembly 18. A plurality of turnbuckles 19 depend from the bolt and wing nut assemblies 14 and the nut and bolt assemblies 18. As shown in FIG. 1, the turnbuckles 19 are disposed vertically and horizontally at opposite sides of the rectangular plate 15, and, if desired, the turnbuckles 19 may also be disposed in positions inclined to the horizontal, as depicted for example at 19*a*.

With the foregoing arrangement, it will be seen that any desired degree of tension may be imparted to the canvas 11 by suitable adjustment of the turnbuckles 19. Moreover, any wrinkles or other uneveness which exist or which might be created upon tightening of opposing sets of aligned turnbuckles 19, e.g., the upper and lower vertically positioned turnbuckles 19 depicted in FIG. 1, may be eliminated or minimized by suitable adjustment of the aligned turnbuckles 19 disposed at right angles to the plate 15. So, also the inclined turnbuckles 19*a* may be adjusted as an aid in accomplishing the same purpose.

It will also be observed that the foregoing arrangement permits the user to impart a relatively slight but uniform tension to the canvas, so that such tension will not in itself be a source of deterioration or rupture to the canvas 11.

In a modified form of the invention depicted in FIGS. 3 and 4, rods 20, 21 are employed in lieu of the rectangular plate 15. The rods 20, 21 are provided with eyelets 20*a*, 21*a* which are aligned, as in FIG. 3, so as to accommodate fastening elements such as a bolt 22 and wing nut 23 which, in turn, accommodate one or more turnbuckles 19, 19*a* depending therefrom and disposed in the vertical, horizontal and inclined positions depicted in FIG. 1. The rods 20, 21 are preferably disposed at right angles to each other, as depicted in FIG. 3, although it is to be understood that other arrangements of the rods 20, 21 may also be resorted to. It will be seen that this form of the invention is extremely lightweight and that by assembling any desired number of rods so as to form rectangular arrangements thereof of any desired height and length, this form of the invention may be employed with paintings of any size.

Another modified form of the invention is depicted in FIG. 5. It has been found that the edges of very old paintings may be on canvases which readily tear, crumble or otherwise deteriorate when exposed to comparatively slight stress. To avoid this result, this form of the invention employs reinforcing means in conjunction with the edges of the canvas. As depicted in FIG. 5 of the drawing, the canvas 11 is engaged with the frame 10. The edge 11*c* of the canvas 11 is impregnated with a stiffening agent, such as a solution of starch or other sealing means, and is disposed between an inverted U-shaped strip of fabric 25 which is also affixed to said edge 11*c* by said sealing means and sewn to the edge 11*c* as at 26, 27 and 28. The upper portion of the inverted U-shaped strip is provided with a nut and bolt assembly 32, the same being engaged with a turnbuckle 19 operable in the previously described manner.

I claim:

1. The combination with a painting on a canvas, comprising:

a. a rigid frame having frontward and rearward sides;
b. the canvas surmounting the frontward side of said frame and overlapping the rearward side thereof;
c. a rigid member disposed within the frame and rearwardly of the canvas surmounting the frontward side of the frame;
d. supporting means engaging the edges of the canvas overlapping the rearward side of the rearward side of the frame;
e. a plurality of adjustable stretching means depending from opposing portions of said rigid member and said supporting means;
f. said adjustable stretching means being disposable at a plurality of predetermined locations on said rigid plate and said supporting means.

2. In a device according to claim 1:

a. said rigid frame having a rectangular conformation;
b. said rigid member comprising:
   i. a rectangular plate;
   ii. a plurality of apertures formed in said plate and disposed in horizontal rows and vertical columns;
   iii. said apertures being adapted to receive removable fastening means;
c. said supporting means comprising:
   i. opposing pairs of planar rods;
   ii. said planar rods being provided with a plurality of apertures;
   iii. said canvas being provided with a plurality of apertures in the vicinity of the edges thereof;
   iv. the apertures in said canvas being aligned with the apertures in said pairs of planar rods and adapted to receive removable fastening means;
d. said plurality of adjustable stretching means including a plurality of turnbuckles affixed to removable fastening means in the apertures in said rectangular plate and in said planar rods.

3. In a device according to claim 1:

a. the said rigid frame having a rectangular conformation;
b. said rigid member comprising:
   i. a plurality of rods disposed in rectangular conformation;
   ii. said rods being provided with eyelets at their end portions;
   iii. said eyelets being adapted to receive removable fastening means;
c. said supporting means comprising:
   i. opposing pairs of planar rods;
   ii. said planar rods being provided with a plurality of apertures;
   iii. said canvas being provided with a plurality of apertures in the vicinity of the edges thereof;
   iv. the apertures in said canvas being aligned with the apertures in said pairs of planar rods and adapted to receive removable fastening means;
d. said plurality of adjustable stretching means including a plurality of turnbuckles affixed to removable fastening means in said eyelets and in said planar rods.

4. In a device according to claim 1:

a. the marginal perimeter of said canvas being impregnated with a stiffening agent;
b. the edges of the canvas including an inverted U-shaped hem depending from the marginal perimeter of the canvas.

* * * * *